United States Patent [19]

Goerlich

[11] Patent Number: 4,848,083

[45] Date of Patent: Jul. 18, 1989

[54] EXHAUST GAS UNIT FOR MULTICYLINDER DIESEL INTERNAL COMBUSTION ENGINES

[75] Inventor: Dieter Goerlich, Emmering, Fed. Rep. of Germany

[73] Assignee: Webasto AG Fahrzeugtechnik, Stockdorf, Fed. Rep. of Germany

[21] Appl. No.: 196,557

[22] Filed: May 20, 1988

[30] Foreign Application Priority Data

May 21, 1987 [DE] Fed. Rep. of Germany ..... 3717141

[51] Int. Cl.[4] ..... F01N 3/02

[52] U.S. Cl. ..... 60/303; 55/466; 55/DIG. 30; 60/311

[58] Field of Search ..... 60/303, 311, 286; 55/DIG. 30, 466

[56] References Cited

U.S. PATENT DOCUMENTS 4,345,431 8/1982 Suzuki et al. .
4,373,330 2/1983 Stark ..... 60/303
4,573,317 3/1986 Ludecke ..... 60/303

FOREIGN PATENT DOCUMENTS 3204176 8/1983 Fed. Rep. of Germany .

*Primary Examiner*—Douglas Hart

*Attorney, Agent, or Firm*—Sixbey, Friedman, Leedom & Ferguson

[57] ABSTRACT

An exhaust gas unit, for multicylinder diesel internal combustion engines with at least one particulate filter and a regeneration device, in which at least four particulate filters are placed parallel to one another in branches of at least one exhaust gas pipe. Thus, in the exhaust gas unit of such a multicylinder diesel internal combustion engine, several small particulate filters can be used that can be produced at resonable cost. At the same time operating safety is increased, since when one of the parallel filters falls or during regeneration of one of them, the operation of the internal combustion engine can continue essentially unimpeded, so that a vehicle equipped with such an internal combustion engine can continue to be operated. With such a design of an exhaust gas unit, a regeneration device in the form of a burner that preferably can be operated by exhaust gases from the exhaust gas unit can be assigned to each pair of filters. Alternatively, a single, common regeneration device in the form of a burner can be provided for all parallel filters of the exhaust gas unit. Such an exhaust gas unit can be advantageously used for a multicylinder diesel internal combustion engine of the V type as well as of the in-line type.

16 Claims, 4 Drawing Sheets

EXHAUST GAS UNIT FOR MULTICYLINDER DIESEL INTERNAL COMBUSTION ENGINES

BACKGROUND AND SUMMARY OF THE INVENTION

The invention relates to an exhaust gas unit for multicylinder diesel internal combustion engines with at least one particulate filter in the exhaust gas pipe and a regeneration device.

Because of the exhaust gas regulations to be expected for diesel internal combustion engines, to purify exhaust gas it will be necessary to place in the exhaust gas unit a particulate filter or soot filter that filters out the particulate and soot components in the exhaust gas. Thus, for multicylinder diesel internal combustion engines a particulate filter is necessary that has very large dimensions and is very expensive. If this large filter becomes damaged, for example due to clogging, the internal combustion engine and along with it the vehicle equipped with it are no longer able to function.

Arrangements where two particulate filters are arranged in parallel branches of an exhaust line and are alternately regenerable by gases produced by a burner, the outlet of which is selectively connectable to either branch of the exhaust line, is known from U.S. Pat. No. 4,345,431 and German Offenlegungsschrift No. 32 04 176. Now, if in a multicylinder diesel internal combustion engine two particulate filters are provided in the exhaust gas unit, the particulate filters of course can be made smaller and if one of the particulate filters fails the internal combustion engine and the vehicle equipped with it can still be operated, but difficulties relating to the filter operation result. If, for example, one of the filters is regenerated, then only the other filter is working in filter operation and the pressure on the one filter working in filter operation becomes so high that the engine operation is impaired. Even if one filter fails because it becomes damaged, the pressure occurring on the still remaining filter is too high for normal operation.

The object of the invention is thus to provide, while overcoming the difficulties described above, an exhaust gas unit for multicylinder diesel internal combustion engines of the type mentioned above that can be made at reasonable costs and, in the case of regeneration and damaging of a filter, at least a continued operation of the multicylinder diesel internal combustion engine and an operation of the vehicle is equips are assured.

According to the invention an exhaust gas unit for multicylinder diesel internal combustion engines with at least one particulate filter in the exhaust gas pipe and a regeneration device is distinguished in that at least four particulate filters are placed parallel to one another in the exhaust gas pipe. Since in the exhaust gas unit according to the invention at least four particulate filters are thus provided, the latter can be dimensioned relatively small, at least in diameter, so that the installation volume for the particulate filters, seen overall, is increased only insubstantially. Furthermore, such small-sized particulate filters can be produced at reasonable costs and can be placed in the exhaust gas pipe at a distance from the multicylinder diesel internal combustion engine at a suitable place.

Moreover, the design according to the invention obtains the advantage that, even when one of the filter fails, at least three parallel particulate filters are available for the filtering operation so that the multicylinder diesel internal combustion engine continues to operate almost unimpaired and a vehicle equipped with such an engine can continue to be operated. The pressure changes occurring in the exhaust gas unit due to the failure and/or shutting off for regeneration of any particular filter are relatively limited since the exhaust gas pressure to the filters remaining in operation does not increase very much.

Preferably, according to the invention, the design is made in such a way that a regeneration device in the form of a burner is assigned to each pair of filters and a flap is placed at the branching point to the particulate filters. With this configuration each pair of particulate filters, together with the assigned regeneration device, forms an independent, operable subcomponent group of the exhaust gas unit so that both parallel pairs of filters can operate and be regenerated, alternately and without influence of one on the other. Also, with this kind of design, essentially only one flap is needed per filter pair, which is preferably placed at the branching point to the particulate filters. To regenerate one of the filters of the filter pair, the filter to be regenerated can be uncoupled from the flow of exhaust gas by this flap and with the aid of the burner of the regeneration device the clogged filter is then freed of soot in that high temperature gases from the burner are supplied to heat the filter to the ignition temperature of the soot.

According to an advantageous further development according to the invention, which leads to a simplification with regard to the regeneration device, for the regeneration of all filters, a common burner is provided, a flap is placed at the branching points of each pair of filters, a common high temperature regeneration gas pipe that is connected to the burner outlet is connected to the branching points, and a flap is placed in the regeneration gas pipe to guide the regeneration gases from the burner to one of the pairs of filters. With this design, more flaps are required in the exhaust gas pipes leading to the particulate filters than in the previously explained configuration, specifically at least three, but for the regeneration of all filters only a single burner is needed in the exhaust gas unit.

Preferably, the burner(s) is/are operated, as a regeneration device in the exhaust gas unit, with exhaust gas from the exhaust gas line so that no great demands are placed on the airtightness of the flaps provided in the pipes leading to the filters, in a manner similar to that described in my copending U.S. patent application Ser. No. 196,558, filed May 20, 1988, claiming priority of German Patent Application No. P 37 17 140.2.

To operate the burner or burners with exhaust gas, there is connected to the burner(s) at least one exhaust gas feed pipe, which is connected to the exhaust gas manifold coming from the internal combustion engine upstream from the branching point to the particulate filters, and optionally, a flow volume control device, in the form of a flap, can be provided in this exhaust gas feed pipe. With such a design, when using a single common burner for all exhaust gas filters, or even when two burners are used, the burner(s) does/do not have exhaust gas from the exhaust line constantly flowing directly through it/them. Instead, only a limited amount is fed to the burner(s), especially when it/they is/are put into operation for regeneration.

According to a preferred configuration, the exhaust gas unit according to the invention is intended for a V-type multicylinder diesel internal combustion engine in which an exhaust gas pipe is assigned to each cylinder bank. Here, the design can be made in such a way that at least two particulate filters are placed in branches of each exhaust gas pipe and both exhaust gas pipes are connected to each other by a connecting pipe upstream of the point where the pipes branch to the particulate filters. This connecting pipe between the two exhaust gas pipes makes it possible that, in the case of regeneration of one of the filters, the exhaust gases, as a whole, can still go through at least three filters to prevent relatively large pressure changes and pressure increases being imposed on the filters. That is, the connecting pipe between the two exhaust gas pipes enables a flow distribution of the exhaust gases and a pressure equalization to occur, so that any one of the particulate filters can be regenerated without an appreciable impairment of the operation of the associated V-type multicylinder diesel internal combustion engine.

According to an alternative configuration, the exhaust gas unit according to the invention is intended for a multicylinder diesel internal combustion engine of the in-line type, in which usually only one exhaust gas pipe coming from the internal combustion engine is present. In this case, this exhaust gas pipe coming from the internal combustion engine is branched downstream from the cylinder bank into a pair of exhaust pipe sections which lead to a pair of branch pipes, within each of which a filter is placed. With such a design, in comparison to the preceding one, an additional connecting pipe can, of course, be dispensed with while still achieving essentially the same advantages. That is, one of the particulate filters can be regenerated without appreciably affecting the operation of the in-line multicylinder diesel internal combustion engine because no great pressure changes, especially pressure increases, result.

In particular, according to the invention, the design of the exhaust gas unit is made in such a way that the individual particulate filters are regenerated consecutively, so that only one of the at least four filters provided overall is uncoupled from filter operation during regeneration. As a result, at least three particulate filters are always available for purification of the exhaust gases.

Of course, instead of operating the burner of the regeneration device with exhaust gas, a burner can also be used that is fed with air from the atmosphere and then, of course, the flaps placed in the pipe system must be able to close in a completely airtight manner to guarantee reliable functioning of such a burner.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 3:
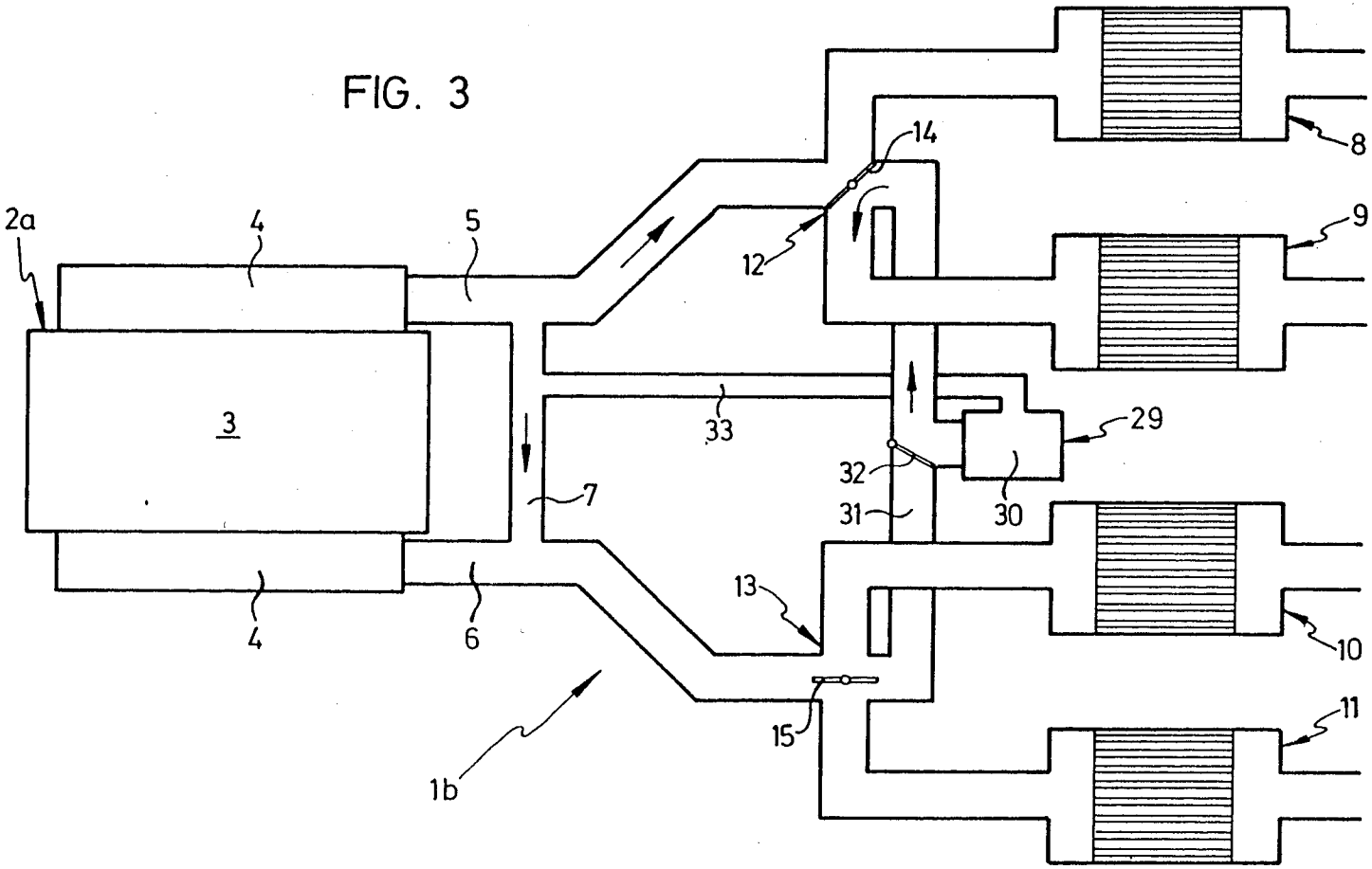
FIG. 3 is a diagrammatic view of a second embodiment of an exhaust gas unit using a single burner for the regeneration of the filters in the exhaust pipes from both cylinder banks of a multicylinder diesel internal combustion engine of the V type.
Figure 4:
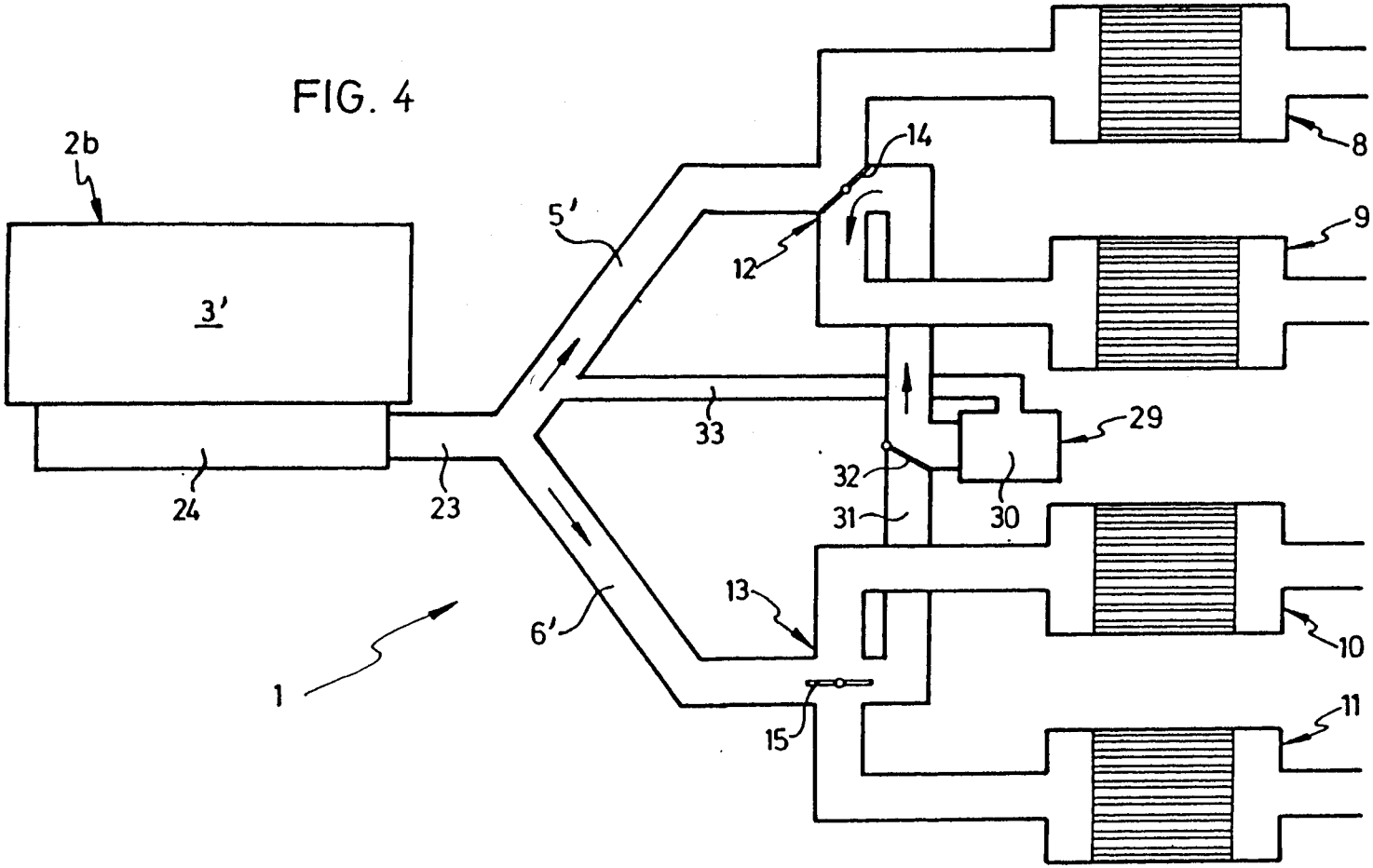
FIG. 4 is a diagrammatic view of the second embodiment of an exhaust gas unit according to the invention that is intended for a multicylinder internal combustion engine of the in-line type.

In the figures of the drawing the same or similar parts are provided with the same reference numerals. However, the exhaust units 1, as a whole, are distinguished alphabetically as 1*a* (FIGS. 1 and 2) and 1*b* (FIGS. 3 and 4).

Figure 1:
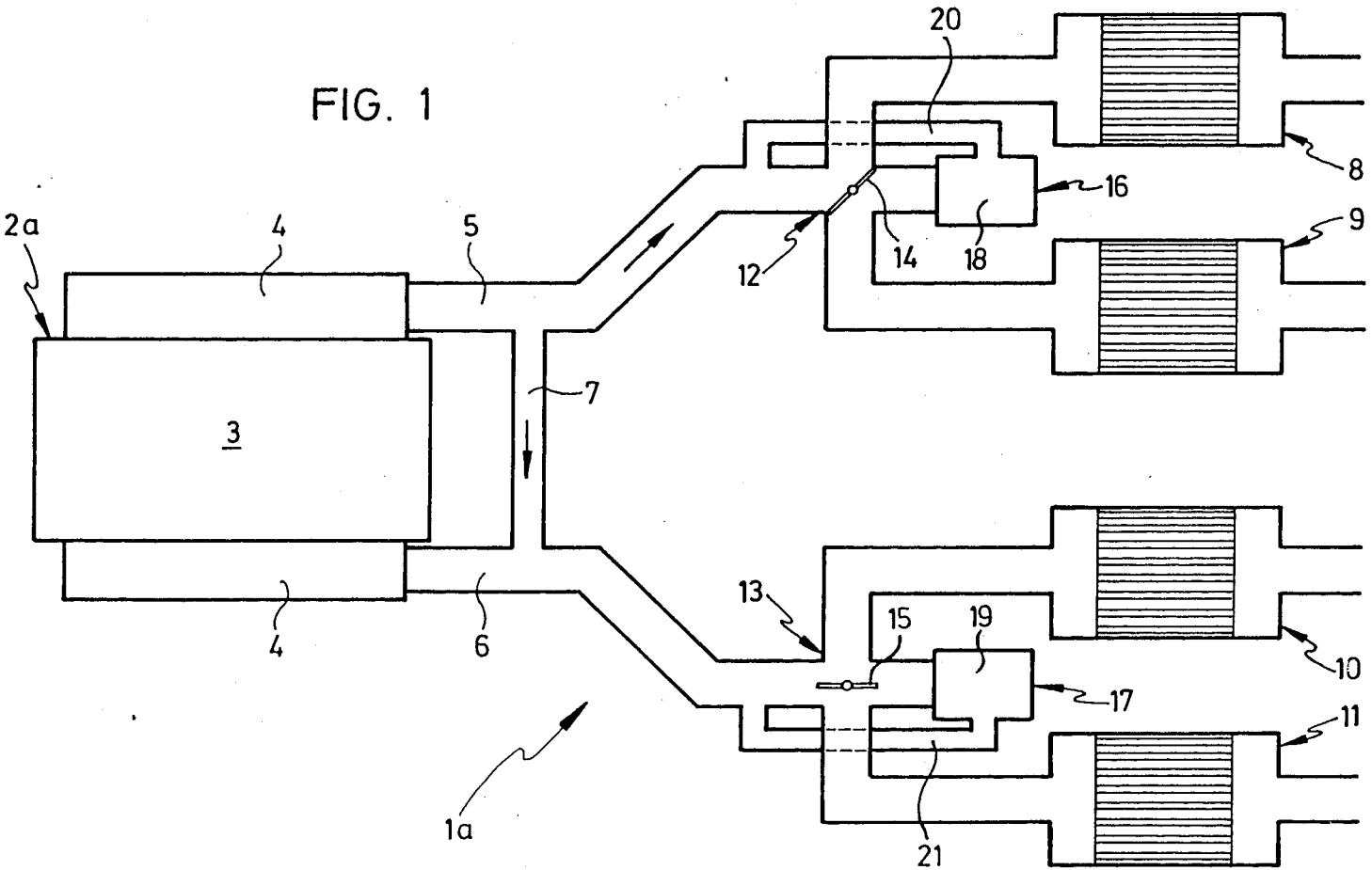
FIG. 1 is a diagrammatic view of a first embodiment of an exhaust gas unit according to the invention that is intended for a multicylinder internal combustion engine of the V-type.

In FIG. 1, the exhaust gas unit designated 1*a*, as a whole, is intended for a V-type multicylinder diesel internal combustion engine 2*a*. With this kind of V-type diesel internal combustion engine, a cylinder bank 4, that comprises several cylinders (not shown in detail), is placed on each of opposite sides of an engine block 3. An exhaust gas pipe 5, 6 is associated with each cylinder bank 4, such as by being connected to the exhaust manifold thereof. Downstream from each cylinder bank 4, both exhaust gas pipes 5, 6 are connected to each other by a connecting pipe 7. Further, in the example shown, an arrangement of two parallel filters 8 and 9 or 10 and 11 are disposed in respective branches of each exhaust gas pipe 5, 6. For this purpose, a branching point 12 or 13 is placed in each exhaust gas pipe 5, 6, creating parallel branches in each of which a respective one of filters 8 to 11 is disposed. In the area of this branching point 12 or 13, a flap 14 or 15 is placed, by which the regeneration of a selected one of filters 8 to 11 can be controlled.

In the example shown in FIG. 1, a regeneration device 16 or 17, in the form of a burner, is provided for each pair of filters 8 and 9 or 10 and 11, so that each pair of filters 8 and 9 or 10 and 11 forms, with the associated burner 18 or 19 of regeneration device 16 or 17, an independently operable subcomponent group. Further, in the example shown, each burner 18, 19 is operated with exhaust gas withdrawn from the respective exhaust gas pipe 5, 6 (instead of an external source of combustion air) by an exhaust gas feed pipe 20 (for burner 18) and an exhaust gas feed pipe 21 (for burner 19). These exhaust gas feed pipes 20, 21 branch off from exhaust gas pipe 5 or 6 downstream from branching point 12, 13. Thus during filter operation only a very limited partial amount of the exhaust gas goes through burners 18, 19 so that burner 18, 19 does not appreciably increase the resistance to flow of the exhaust gas in exhaust gas unit 1*a* and the latter is also protected from fouling. The outlet of burner 18, 19 in each case discharges in the area of branching point 12, 13 into the exhaust gas pipe.

It is noted that the use of the exhaust gas as the combustion air source for production of the regeneration gases by the burners 18, 19, by itself, is not the subject of this invention. In fact, each of the subcomponent groups described above and illustrated in FIG. 1 of this application corresponds to the soot filter unit of the FIG. 1 embodiment of my abovereferenced copending U.S. patent application. Furthermore, any of the other arrangements disclosed in my noted copending Application may be used as the configuration for each subcomponent group instead.

Exhaust gas unit 1*a*, described above, works in the following way. When none of the filters is to be regenerated, both flaps 14, 15 assume, at branching points 12, 13, approximately the position that is illustrated for flap 15. In this case, the exhaust gases from both cylinder banks 4 go from exhaust gas pipes 5, 6 totally through all four particulate filters 8 to 11, so that the total filter capacity available in exhaust gas unit 1*a* essentially corresponds to fourfold the capacities of individual filters 8 to 11. Thus, several small individual filters 8 to 11, which can be produced at a reasonable cost, can be used for an exhaust gas unit 1*a* of a multicylinder diesel internal combustion engine 2*a*.

In exhaust gas unit 1*a*, filters 8 to 11 are regenerated consecutively, i.e., for regeneration, in each case only one of filters 8 to 11 is uncoupled from the flow of exhaust gas from multicylinder internal combustion engine 2*a* at any given time. In the example shown in FIG. 1, particulate filter 9 of the particulate filter pair 8, 9 connected to exhaust gas pipe 5 is being regenerated, while filter 8 of this pair of filters as well as particulate filters 10 and 11 of exhaust gas pipe 6, continue normal filtering operation. To regenerate particulate filter 9, flap 14 is brought into the position shown in FIG. 1, to uncouple filter 9 from the direct flow in exhaust gas pipe 5. From this time on, burner 18 is put into operation with a supply of exhaust gas being fed to burner 18, for use in its combustion process, through exhaust gas feed pipe 20, and burner 18 delivers the high temperature regeneration gases that result from its operation through its outlet. These regeneration gases are diverted by flap 14 so as to be conveyed to particulate filter 9, where they heat the particles in filter 9 to their ignition temperature, so that the particles are burned off filter 9.

During regeneration of filter 9, in overall exhaust gas unit 1*a*, three filters 8, 10 and 11 are, thus, still available and a pressure and exhaust gas stream equalization occurs through connecting pipe 7, which extends between exhaust gas pipes 5 and 6, so that a uniform feeding of all three available particulate filters 8, 10 and 11 is achieved. Thus, the counterpressure occurring on the still available filters 8, 10 and 11 is only minimally higher in comparison with operation of the unit with all four filters 8 to 11, so that the operation of diesel internal combustion engine 2*a* is essentially unaffected.

Even if, in exhaust gas unit 1*a* according to the invention, for example, one of filters 8 to 11 becomes damaged and even possibly two of these filters become damaged, operation of multicylinder diesel internal combustion engine 2*a*, in an emergency mode, is at least still possible, so that the vehicle that is equipped with such a diesel internal combustion engine 2*a* can still be driven further with reduced power. Thus, the operating safety aspect is taken into consideration.

In the same manner as has been described in connection with the regeneration of particulate filter 9, each of the other filters 8, 10 and 11 can be regenerated, in turn, if need be, by correspondingly changing the positions of flaps 14 and 15.

Figure 2:
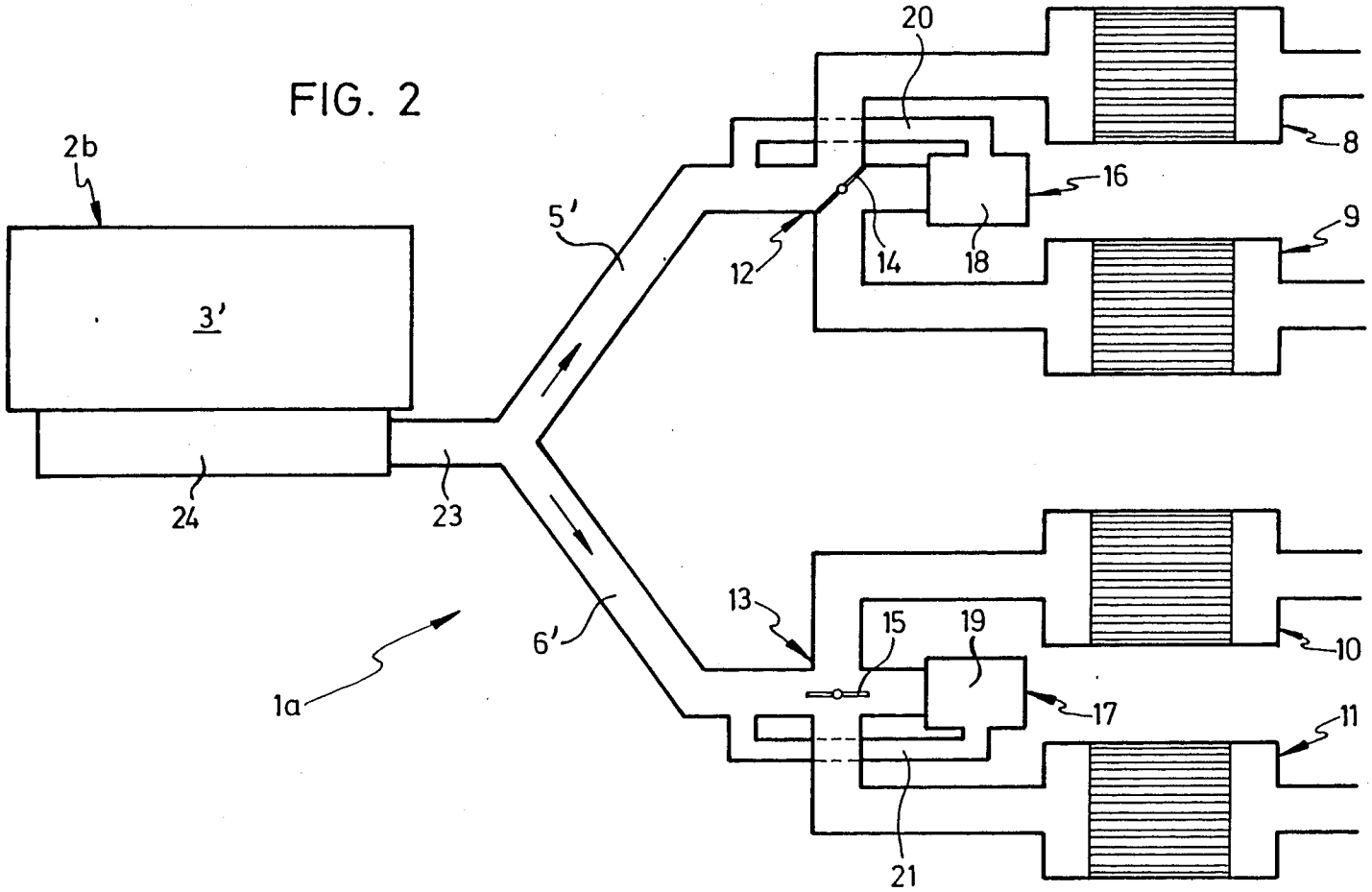
FIG. 2 is a diagrammatic view of the first embodiment of an exhaust gas unit according to the invention that is intended for a multicylinder internal combustion engine of the in-line type.

An example of an application of exhaust gas unit 1*a*, according to the invention, for a multicylinder diesel internal combustion engine 2*b* of the in-line type is explained by FIG. 2. Here, for example, engine 3' may be a 6-cylinder diesel internal combustion engine of the in-line type. With this type of internal combustion engine, an exhaust gas manifold 24 is provided only on one side of engine block 3', and feeds into an exhaust gas pipe 23. Downstream from cylinder bank 4', the single exhaust gas pipe 23 branches into exhaust gas pipe sections 5' and 6' which correspond functionally to exhaust gas pipes 5 and 6 in FIG. 1. The downstream arrangement of particulate filters 8 to 11 and regeneration devices 16, 17 in the form of burner devices 18, 19 is the same as the arrangement of exhaust gas unit 1*a* according to FIG. 1. Thus, a description of this arrangement, as well as a description of the way it functions, is unnecessary.

FIG. 3 shows an alternative configuration of an exhaust gas unit, designated overall by 1*b* and, as an example, an application to a V-type multicylinder diesel internal combustion engine 2*a* is, again, utilized. In the same or an analogous way, this exhaust gas unit 1*b* can, of course, also be used in a multicylinder diesel internal combustion engine of the in-line type. For that purpose, for example, exhaust gas unit 1*a* in FIG. 2 would be replaced by exhaust gas unit 1*b* according to FIG. 3.

Similar to the preceding examples, with exhaust gas unit 1*b* according to FIG. 3, an arrangement in which four parallel filters 8 to 11 are also provided. Flaps 14, 15 are placed on the respectively branching points 12, 13 of exhaust gas pipes 5, 6. However, in contrast to the preceding embodiments, with this exhaust gas unit 1*b* of FIG. 3, only a single regeneration device 29 with a single burner 30 is provided and shared in common by both subcomponent groups. A regeneration gas pipe 31, leading from the outlet of burner 30, discharges into the exhaust gas pipes 5, 6 at their branching points 12, 13, at which flaps 14, 15 are located downstream from particulate filters 8 to 11. In this regeneration gas pipe 31, close to the outlet of burner 30, another flap 32 is placed by which the high temperature gases supplied by the burner, during burner operation, can be guided to filter pairs 8 and 9 or 10 and 11, respectively. With the aid of flaps 14, 15 at branching points 12, 13, the gases produced by burner 30 are then guided to the one of filters 8 to 11 to be regenerated, that filter being uncoupled from the supply of exhaust gas flowing from the respective exhaust gas pipe 5 or 6 by the appropriate positioning of flap 14 or 15. In the example shown, particulate filter 9 is being regenerated. In the same or an analogous way, the other particulate filters 8, 10 or 11 can be regenerated, in turn.

In the example shown, the single burner 30, as was the case for burners 18 and 19 in the preceding examples of FIGS. 1 and 2, is operated with exhaust gas as the combustion air source. For this purpose, an exhaust gas feed pipe 33 is connected to burner 30 and branches off, in the example shown, from connecting pipe 7 between the two exhaust gas pipes 5, 6. Thus, it is guaranteed that burner 30 always is reliably supplied with exhaust gas from the multicylinder diesel internal combustion engine 2*a*. But, alternatively, burner 30 can also be fed with air from the atmosphere, instead of exhaust gas, via a blower in a conventional manner. In such a case, of course, care must be taken to ensure that flaps 14, 15, 32 be essentially airtight.

In the same manner that exhaust gas unit 1*a* is able to be used with both V-type (FIG. 1) and in-line type (FIG. 2) multicylinder diesel internal combustion engines, exhaust gas unit 1*b*, according to FIG. 3, may also be utilized with a multicylinder diesel internal combustion engine 2*b* of the in-line type. Such a use of unit 1*b* is shown in FIG. 4. As shown in FIG. 4, in this case, except gas feed pipe 33 for burner 30 branches off from common exhaust gas pipe 23 downstream from the point that it branches into pipe sections 5', 6'. Apart from this, the operation and construction of the FIG. 4 arrangement, conforms with that already described and, thus, no further explanations are necessary.

While I have shown and described various embodiments in accordance with the present invention, it is understood that the same is not limited thereto, but is susceptible of numerous changes and modifications as known to those skilled in the art, and I, therefore, do not wish to be limited to the details shown and described herein, but intended to cover all such changes and modifications as are encompassed by the scope of the appended claims.

What is claimed is:

1. Exhaust gas unit for a multicylinder diesel combustion engine, comprising at least two interconnected exhaust pipe sections, each of said pipe sections leading to at least two parallel branches, a particulate filter being located in each of said parallel branches; and a regeneration device for regeneration of said particulate filters.

2. Exhaust gas unit according to claim 1, wherein the regeneration device is in the form of a pair of burners, each of which is coupled to the branches containing a respective pair of said particulate filters, and wherein a flap is placed at a branching point to each said pair of particulate filters for controlling exhaust gas flow thereto.

3. Exhaust gas unit according to claim 2, wherein an intake of each burner is connected to receive exhaust gas from the exhaust gas pipe.

4. Exhaust gas unit according to claim 1, wherein a single burner is provided for the regeneration of all of the particulate filters; wherein a common regeneration gas pipe is connected to an outlet of the burner and to branching points to respective pairs of said particulate filters; wherein a flap is placed at the branching point to respective pairs of said particulate filters for controlling gas flow to the respective pair of particulate filters; and wherein a further flap is provided as a means for guiding gas from the burner to the branching point of a selected one of the pairs of filters.

5. Exhaust gas unit according to claim 4, wherein an intake of the burner is connected to the exhaust pipe by an exhaust gas feed pipe at a location upstream from the branching points to the pairs of particulate filters.

6. Exhaust gas unit according to claim 1, wherein, for a V-type multicylinder diesel internal combustion engine having a pair of cylinder banks, said interconnected exhaust pipe sections comprise sections of an exhaust gas pipe for each cylinder bank, said sections being connected to each other by a connecting pipe upstream of the branches containing the particulate filters.

7. Exhaust gas unit according to claim 1, wherein, for an in-line multicylinder diesel internal combustion engine, said interconnected exhaust pipe sections comprise sections of a single exhaust gas pipe for connection to an exhaust manifold of the internal combustion engine and branched into a pair of pipe sections downstream from the exhaust manifold.

8. Exhaust gas unit according to claim 1, comprising means for each individual particulate filter to be regenerated in a sequential manner.

9. Exhaust gas unit according to claim 2, wherein, for a V-type multicylinder diesel internal combustion engine having a pair of cylinder banks, said interconnected exhaust pipe sections comprise sections of an exhaust gas pipe for each cylinder bank, said sections being connected to each other by a connecting pipe upstream of the branches containing the particulate filters.

10. Exhaust gas unit according to claim 9, wherein an intake of each burner is connected to receive exhaust gas from the exhaust gas pipe.

11. Exhaust gas unit according to claim 4, wherein, for a V-type multicylinder diesel internal combustion engine having a pair of cylinder banks, said interconnected exhaust pipe sections comprise an exhaust gas pipe for each cylinder bank, said sections being connected to each other by a connecting pipe upstream of the branches containing the particulate filters.

12. Exhaust gas unit according to claim 11, wherein an intake of the burner is connected to the exhaust pipes by an exhaust gas feed pipe at a location upstream from the branching points to the pairs of particulate filters.

13. Exhaust gas unit according to claim 2, wherein, for an in-line multicylinder diesel internal combustion engine, said interconnected exhaust pipe sections comprise a single exhaust gas pipe for connection to an exhaust manifold of the internal combustion engine and branched into a pair of pipe sections downstream from the exhaust manifold.

14. Exhaust gas unit according to claim 13, wherein an intake of each burner is connected to receive exhaust gas from the exhaust gas pipe.

15. Exhaust gas unit according to claim 4, wherein, for an in-line multicylinder diesel internal combustion engine, said interconnected exhaust pipe sections comprise a single exhaust gas pipe for connection to an exhaust manifold of the internal combustion engine and branched into a pair of pipe sections downstream from the exhaust manifold.

16. Exhaust gas unit according to claim 15, wherein an intake of the burner is connected to one of the branched pipe sections in an area upstream from the branching point to the respective pair of the particulate filters located in the parallel branches of the branched pipe section connected thereto.

* * * * *